US007986110B2

(12) United States Patent
Wu et al.

(10) Patent No.: US 7,986,110 B2
(45) Date of Patent: Jul. 26, 2011

(54) LIGHT SOURCE DRIVING DEVICE

(75) Inventors: Ying-Tsun Wu, Jhongli (TW); Chin-Po Cheng, Jhongli (TW); Yong-Long Lee, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 297 days.

(21) Appl. No.: 12/411,411

(22) Filed: Mar. 26, 2009

(65) Prior Publication Data

US 2010/0181918 A1 Jul. 22, 2010

(30) Foreign Application Priority Data

Jan. 16, 2009 (CN) ..... 2009 1 0105117

(51) Int. Cl.
*H05B 37/02* (2006.01)

(52) U.S. Cl. ..... 315/307; 315/224; 315/276; 315/309

(58) Field of Classification Search ..... 315/209 R, 315/224–226, 246, 276, 291, 294, 295, 297, 315/307–309, 312
See application file for complete search history.

(56) References Cited

U.S. PATENT DOCUMENTS 5,485,059 A * 1/1996 Yamashita et al. ..... 315/307
6,285,139 B1 * 9/2001 Ghanem ..... 315/291
7,276,862 B2 * 10/2007 Kim et al. ..... 315/291
7,372,217 B2 * 5/2008 Tsai et al. ..... 315/308
2003/0122508 A1 * 7/2003 Yang et al. ..... 315/307
2007/0090774 A1 * 4/2007 Ger et al. ..... 315/291
2009/0273286 A1 * 11/2009 Veskovic et al. ..... 315/149
2010/0019694 A1 * 1/2010 Chen et al. ..... 315/297

FOREIGN PATENT DOCUMENTS

CN 101105603 A 1/2008

* cited by examiner

*Primary Examiner* — Douglas W Owens
*Assistant Examiner* — Tung X Le
(74) *Attorney, Agent, or Firm* — Frank R. Niranjan

(57) ABSTRACT

A light source driving device for driving a light source includes a power stage circuit, a transformer circuit, a control circuit, and a fault detecting circuit. The power stage circuit converts an external electrical signal to an alternating current (AC) signal. The transformer circuit is connected between the power stage circuit and the light source to convert the AC signal to a high voltage electrical signal adapted for driving the light source. The fault detecting circuit detects whether the light source is nonfunctional, and outputs a fault signal upon the condition that the light source is nonfunctional. The fault detecting circuit includes a voltage level comparison circuit and a variable-benchmark voltage circuit. The control circuit is connected between the fault detecting circuit and the power stage circuit to output a control signal to the power stage circuit based on the fault signal.

10 Claims, 4 Drawing Sheets

LIGHT SOURCE DRIVING DEVICE

BACKGROUND

1. Technical Field

Embodiments of the present disclosure relate to light source driving devices, and particularly to a light source driving device with a fault detecting function.

2. Description of Related Art

FIG. 4 is a light source driving device with a fault detecting function. A power stage circuit 30 converts an external electrical signal to an alternating current (AC) signal. The AC signal is converted to a sine-wave signal to drive the light source 10 via a transformer circuit 20. A control circuit 40 is connected to the power stage circuit 30 to control output of the power stage circuit 30. A voltage level comparison circuit 50 is connected to the control circuit 40 to check whether a difference between a lamp status feedback signal and a benchmark voltage is within a predefined range so as to determine whether the light source 10 is nonfunctional and output a fault signal. The control circuit 40 turns off the output of the power stage circuit 30 based on the fault signal.

The benchmark voltage often uses a fixed bias voltage. However, the lamp status feedback signal often varies according to a lamp brightness control signal or a surrounding temperature. Because the voltage level comparison circuit 50 compares the varied lamp status feedback signal to the benchmark voltage of a fixed bias voltage, unreliable detection of faults may occur. Therefore, the light source driving device cannot exactly determine whether the light source 10 is nonfunctional.

DETAILED DESCRIPTION

Figure 1:
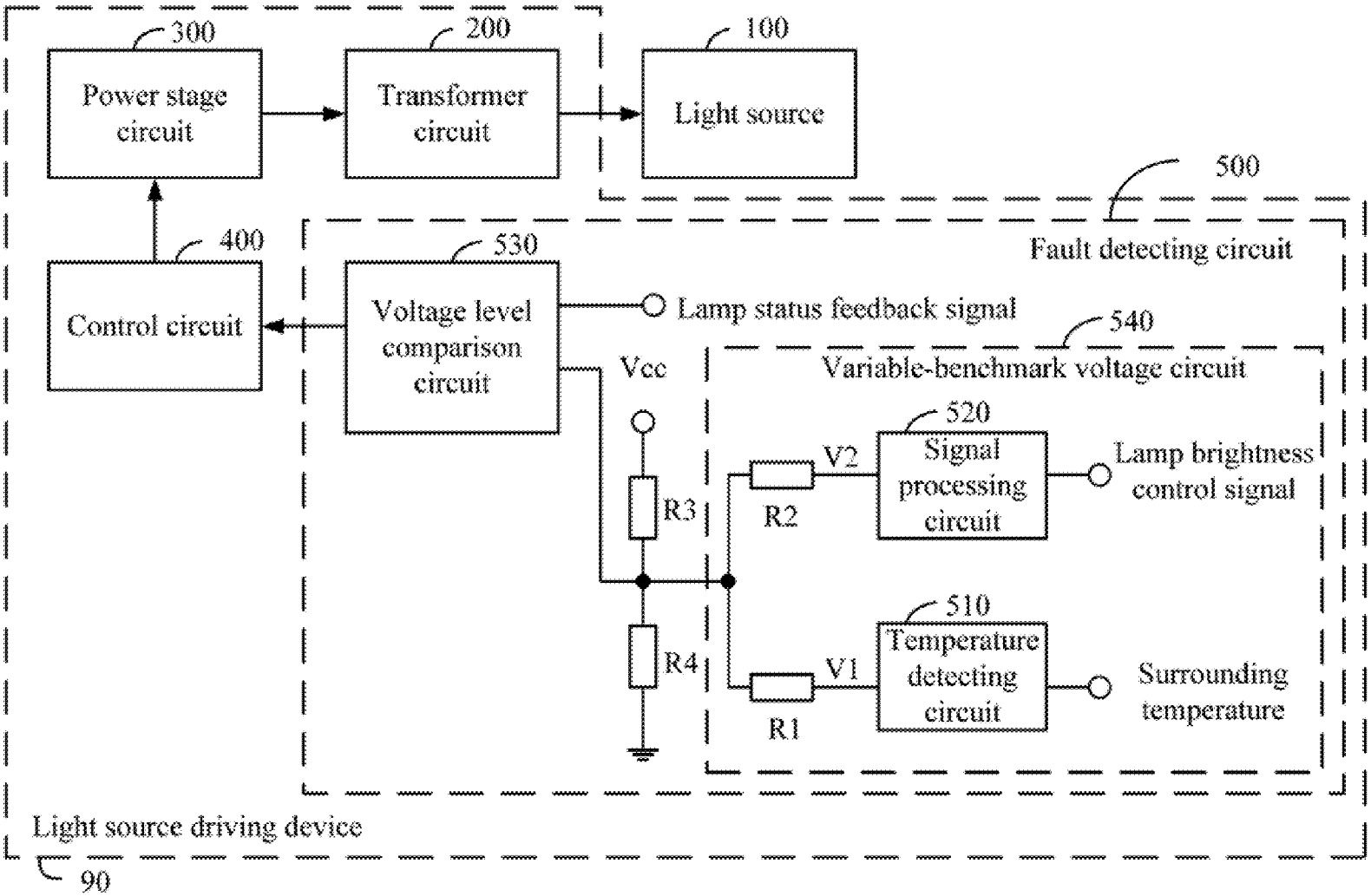
FIG. 1 is a block diagram of one embodiment of a light source driving device in accordance with the present disclosure, the light source driving device including a temperature detecting circuit and a signal processing circuit.

FIG. 1 is a block diagram of one embodiment of a light source driving device 90 to drive a light source 100 in accordance with the present disclosure. In one embodiment, the light source driving device 90 includes a transformer circuit 200, a power stage circuit 300, a control circuit 400, and a fault detecting circuit 500. The light source driving device 90 has a fault detecting function. That is, the light source driving device 90 automatically turns off output of the power stage circuit 300 upon detecting that the light source 100 is nonfunctional. In one embodiment, the light source 100 includes a plurality of lamps, and nonfunctional operation of the light source 100 may include a broken lamp, a disconnection of a lamp, and so on.

The power stage circuit 300 converts an external electrical signal to an alternating current (AC) signal. The transformer circuit 200 is connected between the power stage circuit 300 and the light source 100 to convert the AC signal to a high voltage electrical signal adapted to drive the light source 100.

The fault detecting circuit 500 detects whether the light source 100 is nonfunctional and outputs a fault signal upon the condition that the light source 100 is nonfunctional. The control circuit 400 is connected between the fault detecting circuit 500 and the power stage 300 to output a control signal to the power stage circuit 300 based on the fault signal.

In one embodiment, the fault detecting circuit 500 includes a voltage level comparison circuit 530 and a variable-benchmark voltage circuit 540. The voltage level comparison circuit 530 has a first input to receive a lamp status feedback signal, a second input, and an output to output the fault signal.

The variable-benchmark voltage circuit 540 is connected to the second input of the voltage level comparison circuit 530 to provide a variable-benchmark voltage signal according to a lamp brightness control signal and a surrounding temperature of the light source 100. In one embodiment, the variable-benchmark voltage circuit 540 includes a first adding resistor R1, a second adding resistor R2, a temperature detecting circuit 510, and a signal processing circuit 520.

The temperature detecting circuit 510 detects the surrounding temperature of the light source 100, and transforms the surrounding temperature to a first voltage signal V1. The signal processing circuit 520 transforms the lamp brightness control signal to a second voltage signal V2. In one embodiment, the lamp brightness control signal includes controlling current flowing through lamps, dimming duties, and so on.

The first adding resistor R1 is connected between the temperature detecting circuit 510 and the second input of the voltage level comparison circuit 530. The second adding resistor R2 is connected between the signal processing circuit 520 and the second input of the voltage level comparison circuit 530. In one embodiment, the first adding resistor R1 and the second adding resistor R2 are structured and arranged to add the first voltage signal V1 and the second voltage signal V2 to acquire the variable-benchmark voltage signal.

The voltage level comparison circuit 530 respectively receives the lamp status feedback signal and the variable-benchmark voltage signal via the first input and the second input of the voltage level comparison circuit 530, and checks whether a difference between the lamp status feedback signal and the variable-benchmark voltage signal is within a predefined range. The voltage level comparison circuit 530 compares the difference between the lamp status feedback signal and the variable-benchmark signal with the predefined range so as to determine whether the light source 100 is nonfunctional, and to output a fault signal to the control circuit 400 upon the condition that the light source 100 is nonfunctional. In one embodiment, the voltage level comparison circuit 530 outputs the fault signal to the control circuit 400 to turn off the power stage circuit 300 upon the condition that the difference between the lamp status feedback signal and the variable-benchmark voltage signal is not within the predefined range. The voltage level comparison circuit 530 does not output the fault signal upon the condition that the difference between the lamp status feedback signal and the variable-benchmark voltage signal is within the predefined range. In practical applications, the predefined range can be defined according to different requirements. In one example, the predefined range may be 0.5V.

The fault detecting circuit 500 may further includes a first voltage dividing resistor R3 and a second voltage dividing resistor R4 connected in series between a reference voltage source Vcc and a ground. A common node of the first voltage dividing resistor R3 and the second voltage dividing resistor R4 is connected to the second input of the voltage level comparison circuit 530 to slightly adjust the variable-benchmark voltage signal.

Figure 2:
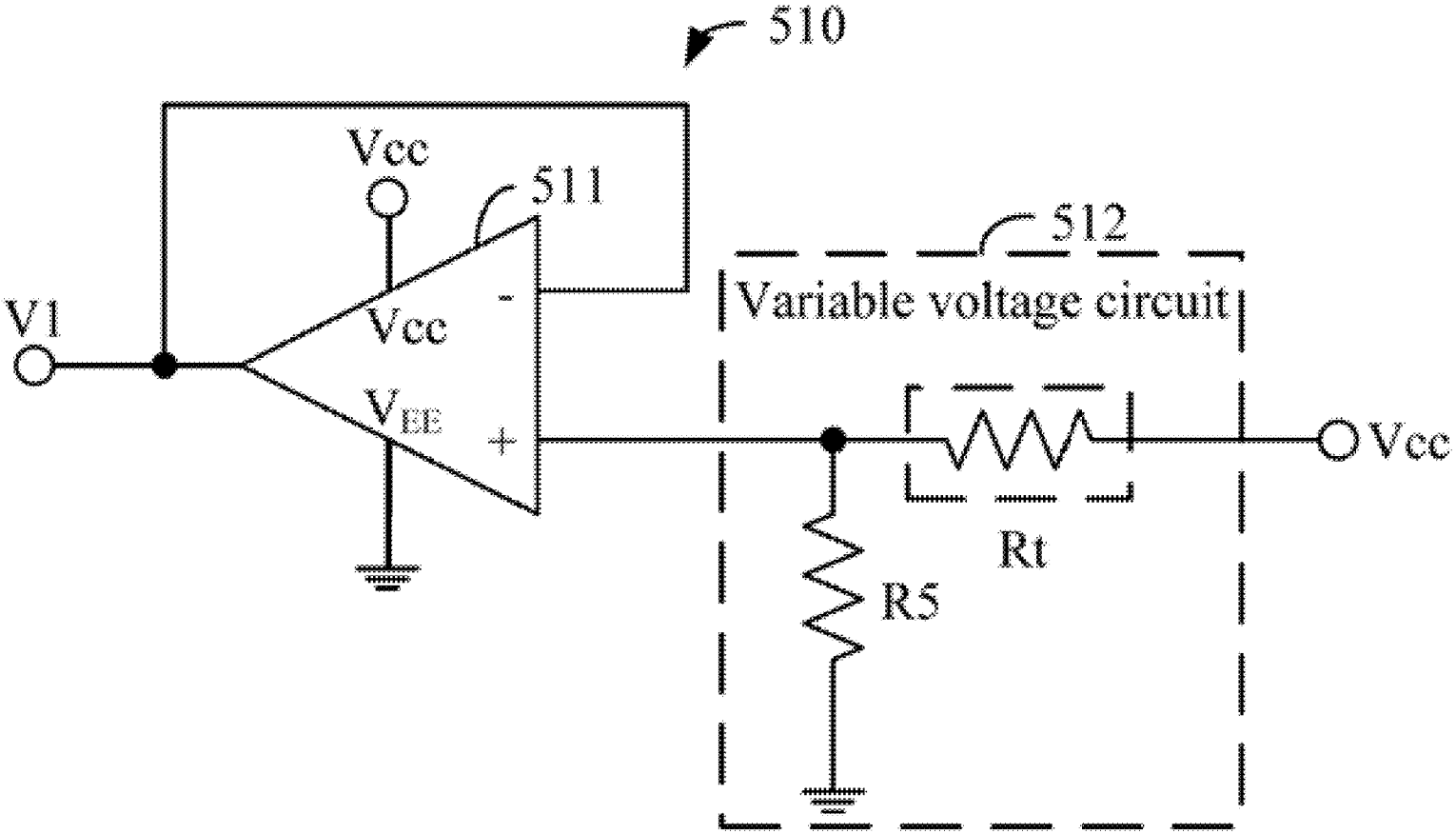
FIG. 2 is a circuit diagram of one embodiment of the temperature detecting circuit in accordance with the present disclosure.

FIG. 2 is a circuit diagram of one embodiment of the temperature detecting circuit 510 in accordance with the present disclosure. In one embodiment, the temperature detecting circuit 510 includes a first operational amplifier 511 and a variable voltage circuit 512.

The variable voltage circuit 512 includes a temperature sensitive resistor Rt and a third voltage dividing resistor R5 connected in series between the reference voltage source Vcc and the ground to divide the reference voltage source Vcc to transform the surrounding temperature to the first voltage signal V1. In one embodiment, the first voltage signal V1 is a direct current (DC) voltage signal.

A non-inverting input of the first operational amplifier 511 is connected to a common node of the temperature sensitive resistor Rt and the third voltage dividing resistor R5, and an inverting input of the first operational amplifier 511 is connected to an output of the first operational amplifier 511. Thus, an output voltage of the first operational amplifier 511 is substantially equal to an input voltage of the first operational amplifier 511, both being V1. Accordingly, the first operational amplifier 511 obtains effective isolation between the output voltage and the input voltage of the first operational amplifier 511. In one embodiment, the first operational amplifier 511 is a voltage follower. An input impedance of the first operational amplifier 511 is very high, and an output impedance of the first operational amplifier 511 is very low.

Figure 3:
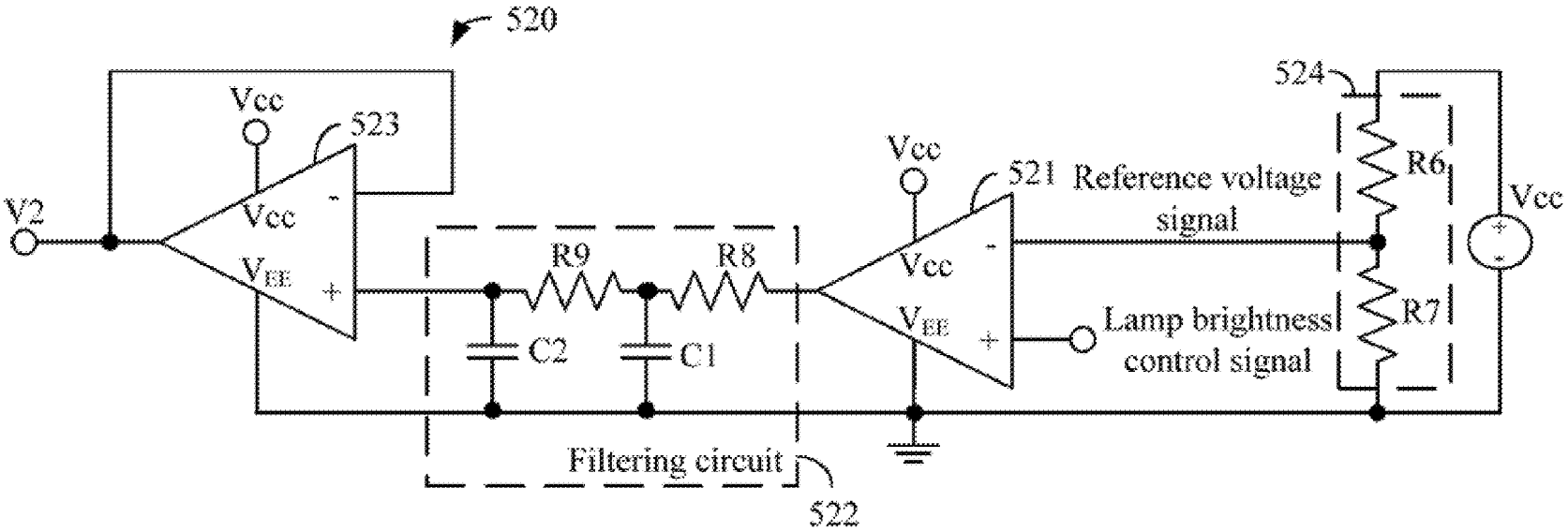
FIG. 3 is a circuit diagram of one embodiment of the signal processing circuit in accordance with the present disclosure.
Figure 4:
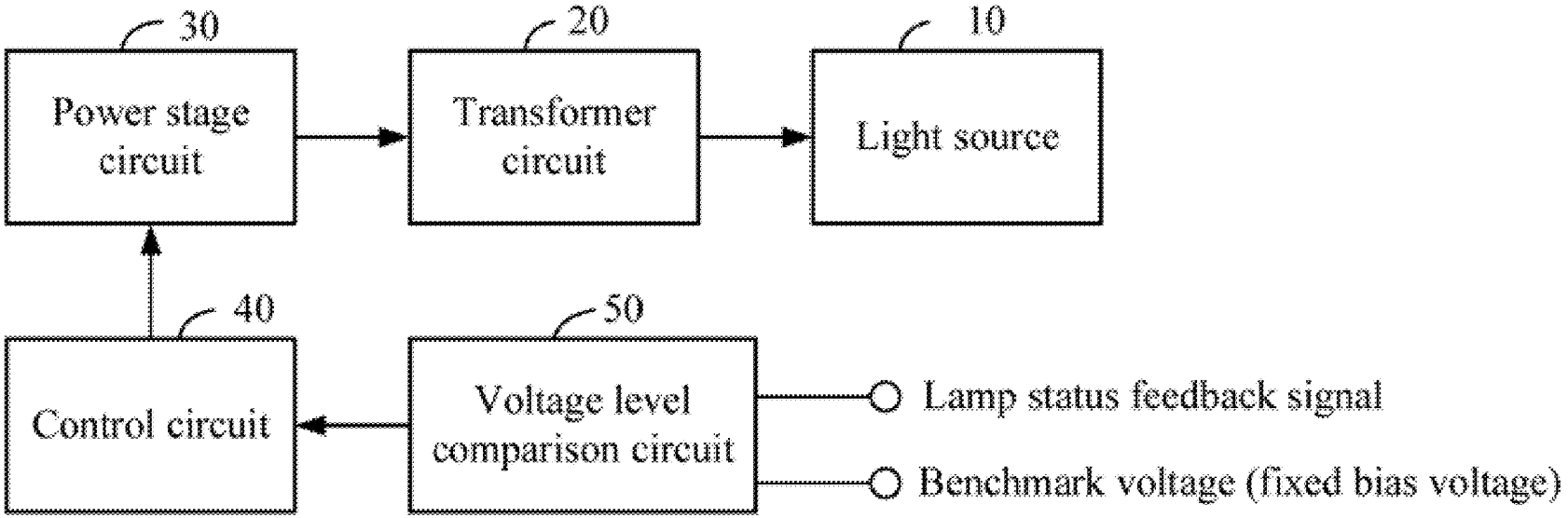
FIG. 4 (Related Art)
FIG. 4 is a light source driving device.

FIG. 3 is a circuit diagram of one embodiment of the signal processing circuit 520 in accordance with the present disclosure. In one embodiment, the signal processing circuit 520 includes a second operational amplifier 521, a filtering circuit 522, and a third operational amplifier 523.

An inverting input of the second operational amplifier 521 receives a reference voltage signal, and a non-inverting input of the second operational amplifier 521 receives the lamp brightness control signal. The second operational amplifier 521 compares the reference voltage signal with the lamp brightness control signal to output a high-low voltage level signal. In one embodiment, the second operational amplifier 521 is a voltage comparator.

The filtering circuit 522 is connected to an output of the second operational amplifier 521 to transform the high-low voltage level signal to the second voltage signal V2.

A non-inverting input of the third operational amplifier 523 is connected to the filtering circuit 522, and an inverting input of the third operational amplifier 523 is connected to an output of the third operational amplifier 523. Thus, an output voltage of the third operational amplifier 523 is substantially equal to an input voltage of the third operational amplifier 523, both being V2. Accordingly, the third operational amplifier 523 obtains effective isolation between the output voltage and the input voltage of the third operational amplifier 523. In one embodiment, the third operational amplifier 523 is a voltage follower. An input impedance of the third operational amplifier 523 is very high, and an output impedance of the third operational amplifier 523 is very low.

The signal processing circuit 520 may further include a voltage divider 524 connected to the inverting input of the second operational amplifier 521. The voltage divider 524 divides the reference voltage source Vcc to output the reference voltage signal to the inverting input of the second operational amplifier 521. In one embodiment, the voltage divider 524 includes a fourth voltage dividing resistor R6 and a fifth voltage dividing resistor R7 connected in series between two ends of the reference voltage source Vcc. A common node of the fourth voltage dividing resistor R6 and the fifth voltage dividing resistor R7 is connected to the inverting input of the second operational amplifier 521 to output the reference voltage signal to the inverting input of the second operational amplifier 521.

In one embodiment, the filtering circuit 522 includes a first filtering resistor R8, a second filtering resistor R9, a first filtering capacitor C1, and a second filtering capacitor C2.

The first filtering resistor R8 and the second filtering resistor R9 are connected in series between the output of the second operational amplifier 521 and the non-inverting input of the third operational amplifier 523. The first filtering capacitor C1 is connected between a common node of the first filtering resistor R8 and the second filtering resistor R9 and the ground. The second filtering capacitor C2 is connected between the non-inverting input of the third operational amplifier 523 and the ground. A common node of the second filtering capacitor C2 and the second filtering resistor R9 outputs the second voltage signal V2 to the non-inverting input of the third operational amplifier 523.

Thus, the lamp status feedback signal varies according to the lamp brightness control signal and the surrounding temperature of the light source 100. The fault detecting circuit 500 dynamically adjusts the variable-benchmark voltage signal inputted to the voltage level comparison circuit 530 according to the lamp brightness control signal and the surrounding temperature. Then, the voltage level comparison circuit 530 compares the varied lamp status feedback signal to the dynamically adjusted variable-benchmark voltage signal, which leads to reliable detection of faults. Therefore, the light source driving device 90 determines whether the light source 100 is nonfunctional with a high reliability.

While various embodiments and methods of the present disclosure have been described above, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A light source driving device for driving a light source comprising:

a power stage circuit that converts an external electrical signal to an alternating current (AC) signal;

a transformer circuit connected between the power stage circuit and the light source, that converts the AC signal to a high voltage electrical signal adapted for driving the light source;

a fault detecting circuit that detects whether the light source is nonfunctional and outputs a fault signal upon the condition that the light source is nonfunctional, the fault detecting circuit comprising:

a voltage level comparison circuit having a first input to receive a lamp status feedback signal, a second input, and an output to output the fault signal; and a variable-benchmark voltage circuit connected to the second input of the voltage level comparison circuit to provide a variable-benchmark voltage signal according to a lamp brightness control signal and a surrounding temperature of the light source; and a control circuit connected between the fault detecting circuit and the power stage circuit, to output a control signal to the power stage circuit based on the fault signal.

2. The light source driving device of claim 1, wherein the variable-benchmark voltage circuit comprises:

a temperature detecting circuit that detects the surrounding temperature of the light source, and transforms the surrounding temperature to a first voltage signal;

a first adding resistor connected between the temperature detecting circuit and the second input of the voltage level comparison circuit;

a signal processing circuit that transforms the lamp brightness control signal to a second voltage signal; and a second adding resistor connected between the signal processing circuit and the second input of the voltage level comparison circuit;

wherein the first adding resistor and the second adding resistor are structured and arranged to add the first voltage signal and the second voltage signal to acquire the variable-benchmark voltage signal.

3. The light source driving device of claim 2, wherein:

the voltage level comparison circuit checks whether a difference between the lamp status feedback signal and the variable-benchmark voltage signal is within a predefined range to determine whether the light source is nonfunctional, and outputs the fault signal to the control circuit upon the condition that the light source is nonfunctional;

the control circuit outputs the control signal to turn off the power stage circuit based on the fault signal.

4. The light source driving device of claim 3, wherein the voltage level comparison circuit does not output the fault signal upon the condition that the difference between the lamp status feedback signal and the variable-benchmark voltage signal is within the predefined range.

5. The light source driving device of claim 2, wherein the fault detecting circuit further comprises a first voltage dividing resistor and a second voltage dividing resistor connected in series between a reference voltage source and the ground, wherein a common node of the first voltage dividing resistor and the second voltage dividing resistor is connected to the second input of the voltage level comparison circuit to slightly adjust the variable-benchmark voltage signal.

6. The light source driving device of claim 2, wherein the temperature detecting circuit comprises:

a variable voltage circuit comprising a temperature sensitive resistor and a third voltage dividing resistor connected in series between a reference voltage source and the ground, wherein the variable voltage circuit divides the reference voltage source to transform the surrounding temperature to the first voltage signal; and a first operational amplifier having a non-inverting input connected to a common node of the temperature sensitive resistor and the third voltage dividing resistor, and having an inverting input connected to an output of the first operational amplifier such that an output voltage of the first operational amplifier is substantially equal to an input voltage of the first operational amplifier so as to obtain effective isolation between the output voltage and the input voltage of the first operational amplifier.

7. The light source driving device of claim 6, wherein the signal processing circuit comprises:

a second operational amplifier with an inverting input to receive a reference voltage signal and a non-inverting input to receive the lamp brightness control signal, wherein the second operational amplifier compares the reference voltage signal with the lamp brightness control signal to output a high-low voltage level signal;

a filtering circuit connected to an output of the second operational amplifier to transform the high-low voltage level signal to the second voltage signal; and a third operational amplifier with a non-inverting input connected to the filtering circuit and an inverting input connected to an output of the third operational amplifier such that an output voltage of the third operational amplifier is substantially equal to an input voltage of the third operational amplifier so as to obtain effective isolation between the output voltage and the input voltage of the third operational amplifier.

8. The light source driving device of claim 7, wherein the signal processing circuit further comprises a voltage divider connected to the inverting input of the second operational amplifier, wherein the voltage divider divides a reference voltage source to output the reference voltage signal to the inverting input of the second operational amplifier.

9. The light source driving device of claim 8, wherein the voltage divider comprises a fourth voltage dividing resistor and a fifth voltage dividing resistor connected in series between two ends of the reference voltage source, wherein a common node of the fifth voltage dividing resistor and the fourth voltage dividing resistor is connected to the inverting input of the second operational amplifier to output the reference voltage signal to the inverting input of the second operational amplifier.

10. The light source driving device of claim 7, wherein the filtering circuit comprises:

a first filtering resistor and a second filtering resistor connected in series between the output of the second operational amplifier and the non-inverting input of the third operational amplifier;

a first filtering capacitor connected between a common node of the first filtering resistor and the second filtering resistor and the ground; and a second filtering capacitor connected between the non-inverting input of the third operational amplifier and the ground.

* * * * *